United States Patent [19]

Stolar

[11] 4,411,031

[45] Oct. 25, 1983

[54] BUOYANT SWIMMING POOL COVER

[75] Inventor: Mike Stolar, Oakville, Canada

[73] Assignee: Stolar Pool Covers Ltd., Hamilton, Canada

[21] Appl. No.: 326,066

[22] Filed: Nov. 30, 1981

Related U.S. Application Data

[63] Continuation of Ser. No. 211,234, Nov. 28, 1980.

[51] Int. Cl.[3] ..... E04H 3/16; E04H 3/18

[52] U.S. Cl. ..... 4/502; 4/498; 4/500

[58] Field of Search ..... 4/502, 501, 498, 504, 4/503, 500, 499

[56] References Cited

U.S. PATENT DOCUMENTS

| | | | |
|---|---|---|---|
| 2,754,900 | 7/1956 | Karobonik et al. | 4/502 X |
| 2,958,083 | 11/1960 | Shook et al. | 4/502 |
| 3,050,743 | 8/1962 | Lamb | 4/502 |
| 3,087,167 | 4/1963 | Cowan | 4/502 |
| 3,501,783 | 3/1970 | Broadman | 4/500 |
| 3,613,126 | 10/1971 | Granderath | 4/502 |
| 3,747,132 | 7/1973 | Foster | 4/502 |
| 3,916,457 | 11/1975 | Morita | 4/502 |
| 3,982,286 | 9/1976 | Foster | 4/502 |
| 4,091,473 | 5/1978 | Matthews et al. | 4/251 X |
| 4,324,370 | 4/1982 | Guard et al. | 4/502 X |

FOREIGN PATENT DOCUMENTS

| | | | |
|---|---|---|---|
| 2234613 | 1/1974 | Fed. Rep. of Germany | 4/502 |
| 2358755 | 5/1975 | Fed. Rep. of Germany | 4/502 |
| 2450927 | 11/1980 | France | 4/502 |

*Primary Examiner*—Henry K. Artis

*Attorney, Agent, or Firm*—Fleit, Jacobson, Cohn & Price

[57] ABSTRACT

A buoyant swimming pool cover is deployable over the surface of a pool under the influence only of the rotation of a power driven roller that extends horizontally across an end of the pool. The roller, which may be of square section, is driven by an electric motor through a flexible drive means including a pulley rotatable with the roller. The roller is rotated to wind the cover onto the underside of the roller. The roller is arranged below the water level of the pool so that upon reversal of the rotation, the buoyancy of the cover will tend to unwind the cover and allow it to be deployed. The square section of the roller provides a number of points at which adjacent layers nip one another to prevent unravelling of the cover as the roller rotates.

22 Claims, 5 Drawing Figures

BUOYANT SWIMMING POOL COVER

This application is a continuation of Ser. No. 86/211,234 filed Nov. 28, 1980.

The invention relates to swimming pool cover assemblies of the type in which the cover may be wound onto a roller for storage and unwound to cover the pool.

Swimming pool covers are utilised to reduce heat loss and evaporation from the pool. In recent years, such covers have been made from a flexible plastic sheet having a large number of air pockets on its lower surface. These covers are buoyant and are effective to reduce evaporation and to increase heat transfer to the pool from solar energy. By virtue of their flexible nature, these covers are usually deployed by hand and left at the side of the pool when the pool is in use. Replacement of the cover usually requires two people and is somewhat tedious. As a result the cover is usually taken off the pool in the morning and not replaced until night time, thus minimizing the advantages to be gained from the cover.

It has been proposed to utilize rollers located at one end of a rectangular swimming pool to assist with deployment and storage of the covers. Whilst the roller may be powered to roll the cover onto the roller it is necessary to deploy the cover manually. It has been proposed to deploy the cover by means of cables running in guides at the side of the pool. Such assemblies are inconvenient in that the guides along the sides of the pool may impede easy access to the pool. In both of the above arrangements the cover is maintained above the surface of the pool when rolled, and sometimes in part when unrolled, which renders the cover subject to degradation due to extremes of temperature and the residue of chemicals from the pool water.

U.S. Pat. No. 3,613,126 discloses a pool cover that does not utilize cables or guides for its deployment. In one embodiment the roller is below the surface of the water and, when a brake is released, the buoyancy of the cover wrapped around the roller causes the roller to turn and permits the cover to be deployed. In another embodiment the roller is above the water level by a sufficient amount that the weight of cover depending therefrom tends to turn the roller and deploy the cover. An electric motor may be used to rewind the cover to overcome braking forces in deployment. In both embodiments, the cover is made from a plurality of rigid elements hinged to one another along one edge and relies upon the rigidity of the elements to achieve deployment. This cover is not made from standard materials and therefore is relatively expensive. Further, the rigid nature of the elements does not allow the cover to pass the steps that usually protrude into the pool.

SUMMARY OF THE PRESENT INVENTION

It is therefore an object of the present invention to provide a pool cover assembly in which the above disadvantages are obviated or mitigated.

According to the present invention there is provided a swimming pool cover assembly comprising a roller rotatable about a substantially horizontal axis, a buoyant blanket attached to said roller, support means to support said roller in a generally horizontal disposition with at least a portion thereof below the intended level of water in a pool, and drive means to rotate said roller about said horizontal axis in a direction to cause said blanket to be drawn below the intended level of water and onto said roller at a location below said horizontal axis and to rotate said roller in the opposite direction to unwind said blanket at a speed such as to permit deployment of said blanket by virtue of the buoyancy thereof.

An embodiment of the invention will now be described by way of example only with reference to the accompanying drawings in which FIG. 1 is a perspective view of part of a pool showing a pool cover partly deployed;

Figure 1:
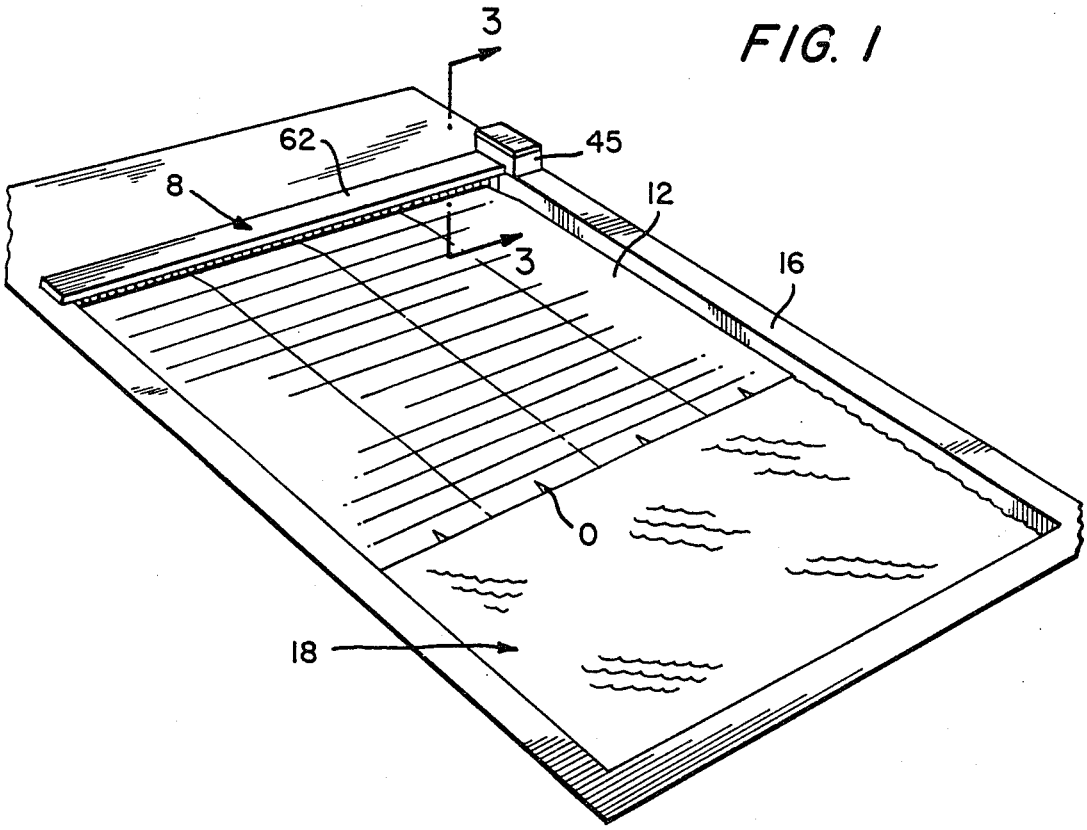

Referring now to the drawings, a cover assembly generally designated 8 is located at one end of a swimming pool 18. Pool 18 is generally rectangular and the cover assembly 8 extends across the width of the pool at one end. The components of the cover assembly may best be seen from FIG. 4 and include a roller 10 that extends between and is rotatably supported by a pair of end supports 14, 15. The end support 15 depends from a transmission housing 45 that sits upon the coping 16 of the pool 18. The end support 14 is secured to the side of the pool opposite the transmission housing and is positioned so that the roller 10 is generally horizontal and parallel to the end of the pool 18. A canopy 62 is supported by lips 63 on the end caps 14, 15 to extend from the coping 16 over the roller 10 to improve the appearance of the assembly and protect the roller 10. A blanket 12 whose shape corresponds to that of the pool is attached to the roller 10 so that upon rotation of the roller 10 in the appropriate direction the blanket 12 is wound onto or unwound from the roller to uncover or cover the surface of the pool.

Figure 5:
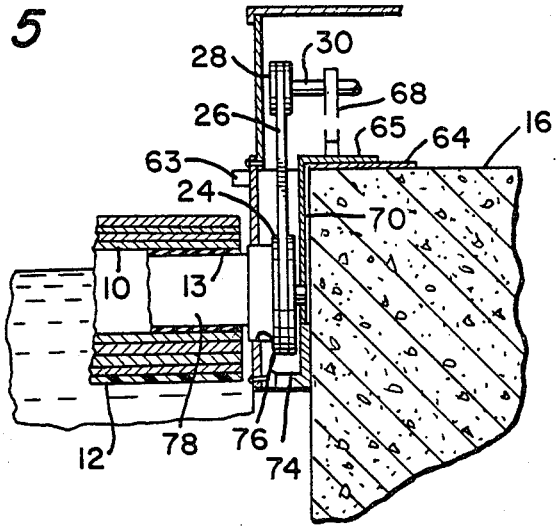
FIG. 5 is a partial section on the line 5—5 of FIG. 3.
Figure 2:
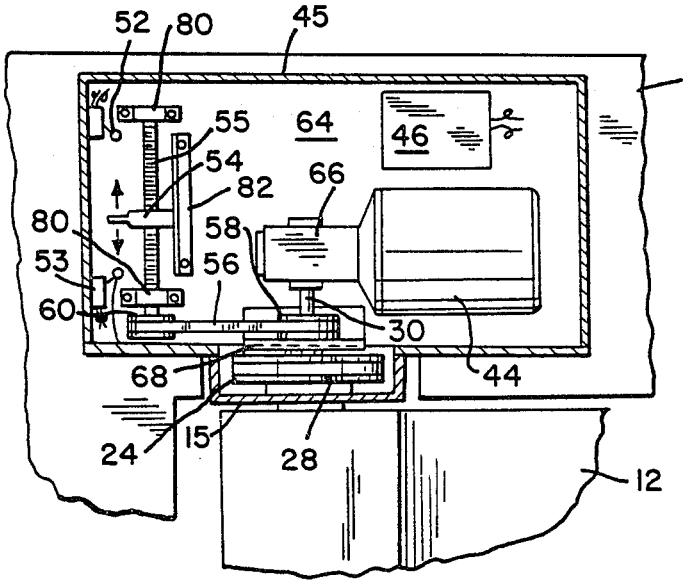
FIG. 2 is a plan view of the transmission used to deploy the cover.

Rotation of the roller 10 is achieved by means of a transmission located within the transmission housing 45 that may best be seen in FIGS. 2 and 5. The housing 45 includes a base 64 that is mounted upon the coping 16. A motor 44 is mounted on the base 64 and transmits its drive through a bevel gear assembly 66 to an output shaft 30. The shaft 30 is supported by bearing block 68 and has a bull gear 28 connected at one end for rotation with the shaft 30.

The end support 15 is attached to the base plate 64 by means of a lip 65 and takes the form of a hollow housing that includes a rear wall 70 and a front wall 72 interconnected by a side wall 74. A driven gear 24 is located between the front and rear walls 72, 70 and is rotatably supported in an aperture 76 in the front face 72. A spigot 78 of square cross section is integrally formed with the driven gear 24 and projects through the aperture 76 into the pool. The bull gear 28 and the driven gear 24 are connected by a toothed drive belt 26 which transmits torque from the shaft 30 to the spigot 78.

Located on the drive shaft 30 intermediate the bevel gear 66 and bull gear 28 is a gear 58. A toothed belt 56 transmits drive from the gear 58 to a gear 60 mounted on a threaded shaft 55. The shaft 55 is rotatably supported in a pair of bearing blocks 80 so that rotation of the shaft 30 will also rotate the threaded shaft 55.

A traveler 54 is threaded on the threaded portion of the shaft 55 and is prevented from rotating by means of a slide 82. Thus upon rotation of the shaft 55, the traveler 54 moves axially along the shaft 55 in a direction depending upon the direction of rotation of the shaft 30. A pair of microswitches 52, 53 are positioned at opposite ends of the shaft 55 so that they are in the path of the traveler 54 and control through control block 46 the operation of the motor 44. Upon engagement of the traveler 54 with either of the microswitches, the motor is stopped and is conditioned so that upon subsequent energization the motor rotates in the opposite direction.

Figure 4:
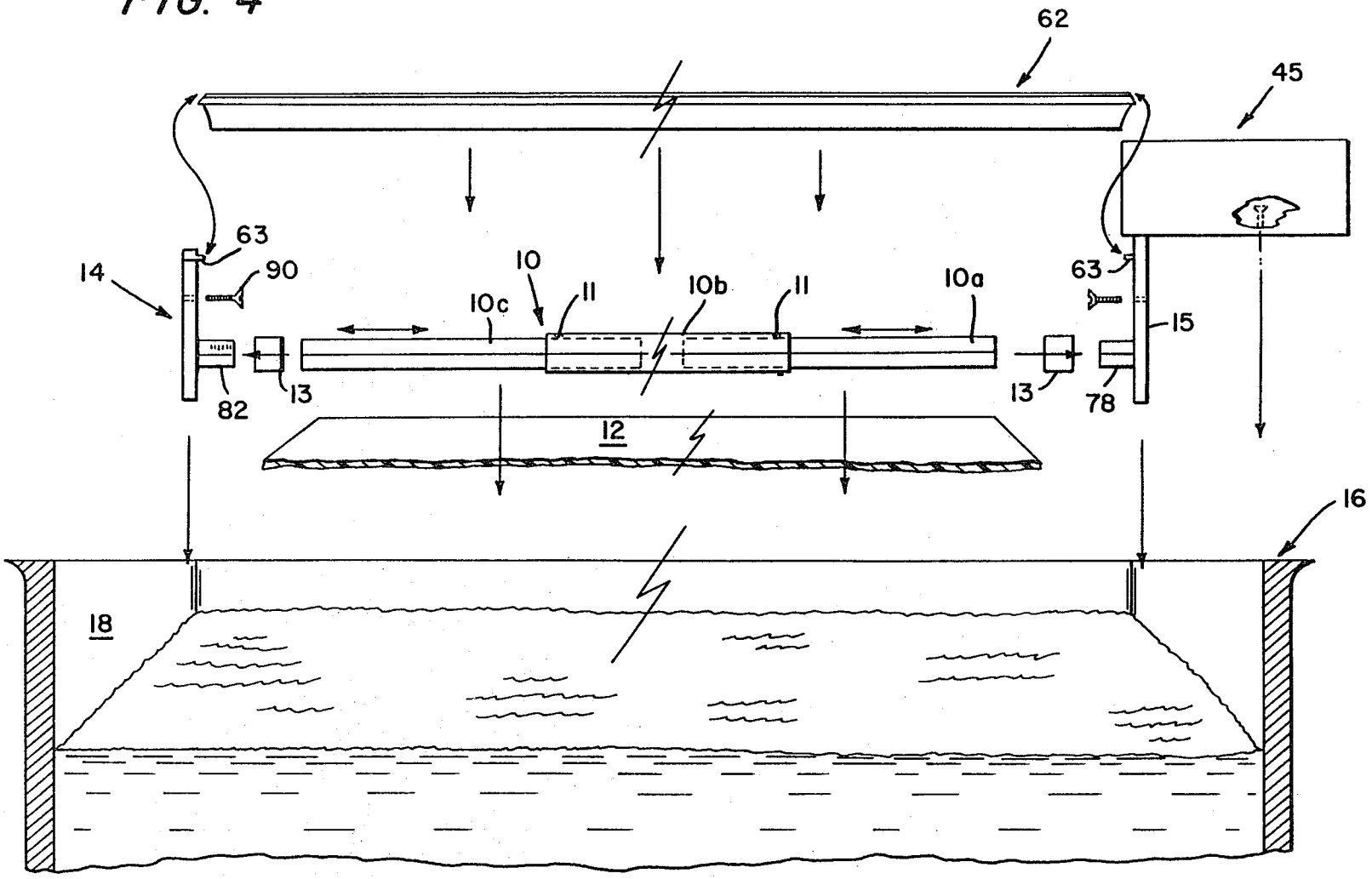
FIG. 4 is an exploded view of the components of the pool cover assembly.

As may best be seen in FIG. 4, the end support 14 also includes a square section spigot 82 similar to the spigot 76. The end support 14 is similar in structure to the support 15 except that the spigot 82 is freely rotatable. To prevent rotation of the end supports about the spigot, both of the end supports 14, 15 are secured to the wall of the pool by means of stainless steel screws 90.

As may best be seen from FIG. 4, the roller 10 is formed from three portions 10*a*, 10*b* and 10*c*. Each of these portions is of square cross section and formed from aluminum tubing. Elastomeric plugs 11 are located between the three portions 10*a*, 10*b* and 10*c* to ensure that the end positions 10*a*, 10*c* are snugly received within the mid portion 10*b*. This permits drive to be transmitted from the end portion 10*a* through the mid portion 10*b* to the end portion 10*c* and allow the end portions 10*a*, 10*c* to slide relative to the mid portion 10*b* to adjust the overall length of the roller 10. Similar elastomeric plugs 13 are located at the ends of the sections 10*a*, 10*c* between the interior surface of the roller 10 and the spigots 78, 82. The plugs 13 allow the roller 10 to bow under the weight of the blanket 12 without inducing a corresponding displacement of the spigot 78. The end portions 10*a*, 10*c* may therefore be slid onto the spigots 78, 82 so that rotation of the spigot 78 induced by the motor 44 causes rotation of the roller 10. The end portions 10*a*, 10*c* typically have an external dimension of $1\frac{3}{4}$ inches between flats and a wall thickness of 0.120 inches. The mid portion 10*b* is made from a similar tubing with an external dimension of 2 inches. This has been found satisfactory for pools up to 18 feet wide and for greater width 2 inch and $2\frac{1}{2}$ inch tubing is used.

One edge of the blanket 12 is attached by suitable means at spaced locations along one of the flat surfaces of the roller 10 so that the upper surface of the blanket is in contact with the outer surface of the roller 10. The blanket 12 is formed from sheet plastics material commonly used for pool covers and available under the trade name Aqua Cover from Canadian Tarpaulin. This blanket utilises a series of sealed hemispherical pockets on the underside of the blanket. An alternative blanket is that known as Blue Shield available from Dauncey Sayles Thermo Engineering of Pickering, Ontario, which is a foam and vinyl sheet blanket. The blanket has a length sufficient to extend along the length of the pool and is attached to the roller so that when fully deployed it lies snugly within the periphery of the pool.

Figure 3:
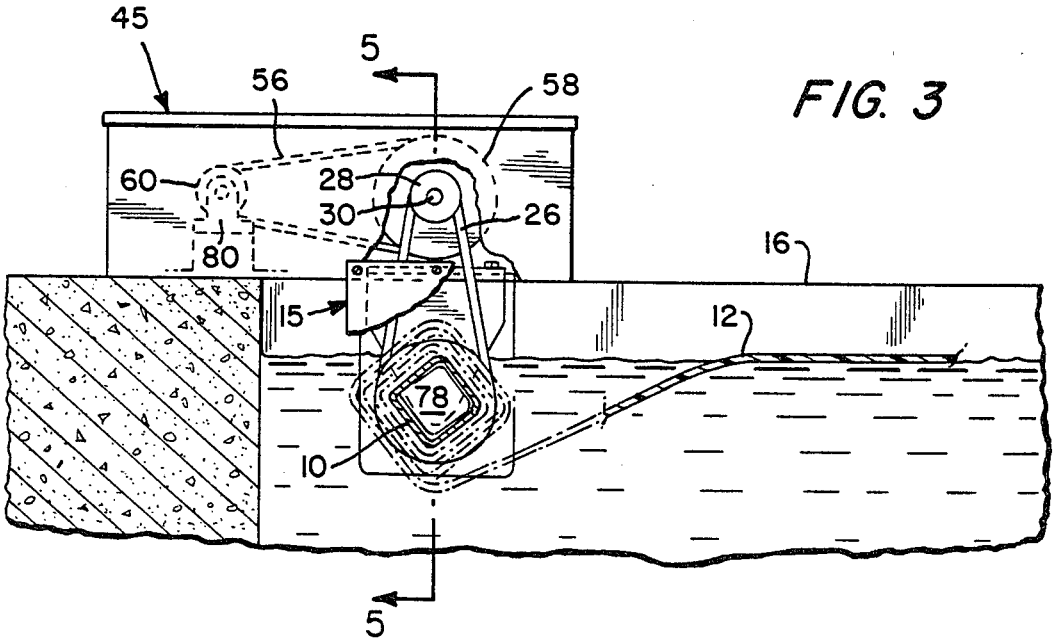
FIG. 3 is a section on the line 3—3 of FIG. 1.

To install the cover assembly 8, the end cover 14 is positioned adjacent one end of the pool and spaced sufficient distance from the end of the pool to allow the blanket 12 to be wound fully upon the roller without interfering with the end wall. The transmission housing 45 is installed on the opposite side of the pool with the end support 15 opposite the end support 14. The length of the end supports 14, 15 is such that the spigots 78, 82 support the roller 10 below the normal level of water in the pool. The roller 10 may then be installed on the spigots 76, 82 by telescoping the end portions 10*a*, 10*b* within the mid portion to decrease the overall length of the roller. When the end portions are aligned with the spigots, they are extended so that they slide over the spigots. The motor is connected to the transmission and run until the slider 54 engages the limit switch 53 to indicate that the roller is in a position corresponding to the cover being fully deployed. The cover is then attached to a downwardly facing surface of the roller 10, with the body of the blanket extending across the surface of the pool. The motor may then be activated to cause the bull gear 28 and therefore the spigot 78 to rotate in a clockwise direction as seen in FIG. 3. Such rotation draws the cover 12 onto the roller below water level until the cover is fully retracted and stored on the roll. The motor is stopped and the limit switch 52 adjusted so that it will automatically stop the rotation of the roller when the cover is fully retracted.

To retract the blanket 12, the motor 44 is activated to rotate the shaft 30 and therefore driven gear 24 clockwise. This rotation is transmitted through the spigot 78 to the roller 10 and pulls the blanket 12 below water level and onto the roller 10. As the roller 10 rotates, the corners of the roller cause localised pressure zones that cause adjacent layers to nip against one another. The limit switch 52 stops rotation of the motor 44 when the blanket 12 is fully retracted so that the end of the blanket 12 remote from the roller 10 is floating on the surface of the pool below the cover 62.

It has also been found advantageous to cut a number of slots as indicated at 90 in FIG. 1 along the leading edge of the blanket 12. These slots are approximately six inches long and allow the leading edge of the blanket to float on the surface even when the surface of the water is comparatively choppy. This prevents the blanket 12 from becoming immersed in the pool and partially unrolling from the roller 10 which would adversely affect the synchronism of the leading edge and the limit switches 52, 53.

To deploy the blanket 12 to cover the pool, the motor 44 is activated to rotate the roller 10 in a counterclockwise direction. The speed of rotation is chosen to be 3.75 rpm which has been found appropriate to allow the blanket 12 to be deployed along the length of the pool without any additional cables or guides. The speed of deployment is critical as too great a speed will not permit the blanket to rise to the surface of the pool in a controlled manner. The upper limit will depend on a number of factors including the length of the pool to be covered but has typically been found to be 5.70 rpm for pools of up to 32 feet in length and 3.75 for pools up to 40 feet. As the roller 10 rotates to deploy the cover the buoyancy of the blanket 12 causes it to rise to the surface of the pool and force the leading edge of the blanket along the length of the pool. It is believed that the use of the square section roller, and the consequent increased pressure at the corner of the roller, ensures that the body of the blanket rotates with the roller 10 rather than simply unravelling on the roller. This ensures that the body of the blanket 12 is subject to the buoyancy forces that cause it to float to the surface and force the leading edge along the length of the pool.

It has also been found that the cover will deflect around obstacles, such as steps, placed along the length of the pool provided thaty are not placed directly adjacent the roller 10, thus increasing the utility of the assembly.

It will be noted that the cover in the fully wound position is substantially immersed in water which avoids the chemicals in the pool drying on the cover and attacking the material. Further a layer of water is contained between the adjacent layers of the blanket as it is rolled which maintains the interior of the blanket wet.

Operation of the motor 44 may be controlled by conventional on/off switch and reversing control or, if preferred, by remote switching device such as conventionally used in automatic garage doors. This allows the cover to be deployed from a remote location and greatly increases the convenience to the pool owner.

The roller 18 may also be rotated by hand to avoid the expense of the electric motor and transmission. In this case a direct connection between a hand wheel installed at the side of the pool and the toothed gear wheel 24 may be provided and the handle rotated at a sufficient speed to allow the cover 12 to deploy itself.

It will be seen therefore that the present invention provides a cover assembly which avoids the need for complicated double acting mechanisms and which stores the blanket in a convenient location at one end of the pool.

Irregular shaped pools may also utilize the cover assembly by trimming the leading edge of the cover to the irregular shape at the end of the pool.

Although the above embodiment shows a roller having a square section, alternative sections may be used. For example, a triangular or hexagonal section would provide the localised areas of increased contact between the layers of the blanket and it is anticipated that an elliptical cross section may also be used to obtain the same effect.

The reducing diameter of the roll of blanket as deployment occurs provides a beneficial reduction in the linear speed of deployment as the length of the deployed blanket increases. Generally this is sufficient to maintain a controlled deployment. If desirable, however, the rotational speed of the motor 44 may be varied as the blanket unrolls by placing additional microswitches in the path of the traveler 54 at locations corresponding to the length of blanket at which a decrease is found necessary. Those microswitches may then control a speed control function within the control block 46.

The location of the roller relative to the water level should also be carefully selected. It has been found satisfactory for ¾ of the body of the roller to be below the water level so that a portion of the rolled blanket is supported above the water. As shown, the lower most surface of the roller is below the water level and if preferred the roller may be positioned so that the entire blanket is immersed in water in the rolled condition.

A significant feature of the cover assembly is the exclusion of air pockets between the blanket and the water as the blanket is deployed. Such pockets are inevitable when deploying a blanket by hand and have a deleterious effect in the efficiency and life of the blanket.

We claim:

1. A swimming pool cover assembly for a swimming pool having an adjacent wall and a remote wall, the cover assembly comprising a roller rotatable about a substantially horizontal axis, a flexible buoyant blanket attached at one end to said roller and wound on said roller in a direction so that the end thereof remote from said attached end extends toward said remote wall of the swimming pool from beneath said roller, support means to support said roller in a generally horizontal disposition with at least a portion thereof below the intended level of water in a pool, and drive means to rotate said roller about said horizontal axis in a direction to cause said blanket to be drawn below the intended level of water and onto said roller at a location below said horizontal axis and to rotate said roller in the opposite direction to unwind said blanket at a speed such as to permit deployment of said blanket by virtue of the buoyancy thereof.

2. A swimming pool cover assembly according to claim 1 wherein said roller has a non-circular cross section.

3. A swimming pool cover assembly according to claim 2 wherein the cross section of said roller is a square.

4. A swimming pool cover assembly according to claim 1 wherein said drive means includes a reversible electric motor.

5. A swimming pool cover assembly for a pool having an adjacent wall and a remote wall, the cover assembly comprising a roller, a pair of supports located at opposite ends of said roller and attachable to the pool to support said roller in a generally horizontal disposition with at least a portion of the roller below the intended water level of said pool, drive means to rotate said roller about a horizontal axis, a flexible buoyant blanket for covering the surface of said pool and having one edge secured to said roller for rotation therewith and being wound on said roller in such a manner that the end thereof remote from said secured edge extends toward said remote wall of the swimming pool from beneath said roller, and control means to control the rotation of said roller, said control means causing rotation of said roller in a direction to draw said blanket onto said roller at a location below the intended level of water with a plane containing the submerged portion of the blanket adjacent said roller passing below said horizontal axis, and causing rotation in an opposite direction to unwind said blanket from said roller at its lowest point and at a speed sufficient to permit the buoyancy of said blanket to move the unwound portion of the blanket along the surface of said pool.

6. A swimming pool cover assembly according to claim 5 wherein said roller has a non-circular cross section.

7. A swimming pool cover assembly for a swimming pool having an adjacent wall and a remote wall, the cover assembly comprising a roller supported at opposite ends thereof to extend along a generally horizontal axis adjacent one end of a pool, said roller having a non-circular cross section, drive means to rotate said roller about said horizontal axis and a flexible buoyant blanket attached at one end to said roller and wound on said roller in a direction so that the end thereof remote from said attached end extends toward said remote wall of the swimming pool from beneath said roller, said drive means rotating said roller in a first direction to wind said blanket onto said roller with said non-circular cross section causing zones of localized compression between adjacent layers of said blanket as it is drawn onto said roller and in a second direction opposite to said first direction to unwind said cover, said zones of localized compression inhibiting relative rotation between said roller and said blanket.

8. A swimming pool cover assembly according to claim 7 wherein the cross section of said roller is square.

9. A swimming pool cover assembly according to claim 8 wherein said roller is supported below the water level of said pool.

10. A swimming pool cover assembly for a swimming pool having an adjacent wall and a remote wall, the cover assembly comprising a roller having a non-circular cross section, a pair of supports at opposite ends of said roller to support said roller for rotation about a generally horizontal axis located below the water level of said pool, drive means to rotate said roller about said horizontal axis, and a flexible buoyant blanket having one edge attached to said roller for rotation therewith and being wound on said roller in such a manner that the end thereof remote from said attached edge extends toward said remote wall of the swimming pool from beneath said roller, said blanket being drawn onto said roller by rotation thereof in a first direction and being deployed across said pool by rotation in an opposite direction at a speed sufficient to permit the buoyancy of the blanket to induce movement of the blanket along the surface of the pool.

11. A swimming pool cover assembly according to claim 10 wherein said roller is of square cross section.

12. A swimming pool cover assembly according to claim 11 wherein each said support means includes a housing and a drive member rotatable relative to said housing, said drive member engaging said roller to provide support therefor and to rotate therewith.

13. A swimming pool cover assembly according to claim 12 wherein said roller is hollow and said drive member engages the interior of said roller.

14. A swimming pool cover assembly according to claim 13 wherein the interior of said roller and said drive member have a corresponding non-circular cross section.

15. A swimming pool cover assembly according to claim 14 wherein said roller is telescopic to permit adjustment of its length for assembly between said end supports.

16. A swimming pool cover assembly according to claim 12 wherein said drive means is connected to one of said drive members to induce rotation of said roller.

17. A swimming pool cover assembly according to claim 16 wherein said drive means includes a reversible electric motor.

18. A swimming pool cover assembly according to claim 17 wherein rotation of said motor causes displacement of a control member between a pair of limit switches, engagement of said control member by said limit switches stopping said motor and conditioning it for rotation in an opposite direction.

19. A swimming pool cover assembly according to claim 18 wherein said blanket is formed from a flexible plastics material and has a plurality of slits cut along the edge opposite to said one edge.

20. For use in a swimming pool including an end wall and a remote wall, a swimming pool cover assembly comprising a roller supported adjacent said end wall and generally parallel thereto, with at least a portion of said roller being disposed below the level of water in said pool, drive means to rotate said roller about a generally horizontal axis, and a flexible buoyant blanket having one edge attached to said roller for rotation therewith and wound on said roller such that the edge remote from the attached edge extends toward the remote wall of the swimming pool from beneath said roller, said drive means winding said blanket onto said roller by rotating said roller in a direction such that the roller surface adjacent said end wall ascends so that said blanket is drawn below the level of said water and toward said end wall to engage the said roller below said horizontal axis.

21. For use in a swimming pool including an end wall and a remote wall, a swimming pool cover assembly comprising a roller supported adjacent said end wall and generally parallel thereto with at least a portion of said roller being disposed below the level of water in said pool, drive means to rotate said roller about a generally horizontal axis, and a flexible buoyant blanket having one edge attached to said roller for rotation therewith and being wound on said roller in such a manner that the end thereof remote from said attached edge extends toward said remote wall of the swimming pool from beneath said roller, said drive means rotating said roller in opposite directions to wind and unwind said blanket, the buoyant forces acting on the unwound portion of said blanket acting to rotate the roller such that the surface of the roller adjacent said end wall descends.

22. A swimming pool cover assembly for a swimming pool having an adjacent wall and a remote wall, the cover assembly comprising a roller rotatable about a substantially horizontal axis, a flexible buoyant blanket attached at one end to said roller and wound on said roller in a direction so that the end thereof remote from said attached end extends toward said remote wall of the swimming pool from beneath said roller, support means to support said roller in a generally horizontal disposition with at least a portion thereof below the intended level of water in a pool, and drive means to rotate said roller about said horizontal axis in a direction to cause said blanket to be drawn below the intended level of water and onto said roller at a location below said horizontal axis and to rotate said roller in the opposite direction to unwind said blanket and impart forward momentum thereto at a speed such as to permit deployment of said blanket by virtue of the buoyancy thereof.

* * * * *